US008544220B2

(12) United States Patent
Milani

(10) Patent No.: US 8,544,220 B2
(45) Date of Patent: Oct. 1, 2013

(54) PROCEDURE FOR MAKING NATURAL POOLS

(76) Inventor: Alessandro Milani, Montegrotto (IT)

( * ) Notice: Subject to any disclaimer, the term of this patent is extended or adjusted under 35 U.S.C. 154(b) by 2 days.

(21) Appl. No.: 13/379,795

(22) PCT Filed: Jul. 7, 2009

(86) PCT No.: PCT/IB2009/052954

§ 371 (c)(1),
(2), (4) Date: Dec. 21, 2011

(87) PCT Pub. No.: WO2011/004218

PCT Pub. Date: Jan. 13, 2011

(65) Prior Publication Data

US 2012/0102874 A1 May 3, 2012

(51) Int. Cl.

| | |
|---|---|
| ***E04B 1/00*** | (2006.01) |
| ***E02D 19/00*** | (2006.01) |
| ***E02D 17/20*** | (2006.01) |
| ***E04G 21/00*** | (2006.01) |

(52) U.S. Cl.
USPC ..... 52/169.7; 52/169.14; 52/741.12; 405/302.7

(58) Field of Classification Search
USPC ..... 52/169.1, 169.2, 169.5, 169.6, 169.7, 52/169.14, 741.11, 741.12; 405/15, 19, 38, 405/50, 268, 302.4, 302.7
See application file for complete search history.

(56) References Cited

U.S. PATENT DOCUMENTS

| | | | | |
|---|---|---|---|---|
| 2,984,050 | A * | 5/1961 | Crooks | 52/264 |
| 3,031,801 | A * | 5/1962 | Leuthesser | 52/741.12 |
| 3,074,080 | A * | 1/1963 | Previti | 52/169.6 |
| 3,990,247 | A * | 11/1976 | Palmer | 405/16 |
| 4,124,963 | A * | 11/1978 | Higuchi | 52/741.15 |
| 4,125,983 | A * | 11/1978 | Jarrell | 52/741.12 |
| 4,420,275 | A * | 12/1983 | Ruser | 405/217 |
| 4,622,790 | A * | 11/1986 | Johansson | 52/302.3 |
| 4,655,637 | A * | 4/1987 | Vignocchi | 405/17 |
| 4,948,296 | A * | 8/1990 | Salter | 405/55 |
| 5,106,229 | A * | 4/1992 | Blackwell | 405/52 |
| 5,806,252 | A * | 9/1998 | Scuero | 52/169.7 |
| 6,558,074 | B2 * | 5/2003 | Jansson | 405/16 |
| 7,017,309 | B2 * | 3/2006 | McNett | 52/169.14 |
| 7,877,952 | B2 * | 2/2011 | Milani | 52/741.12 |
| 8,062,143 | B1 * | 11/2011 | Meersman | 473/173 |
| 2009/0022550 | A1 * | 1/2009 | Roesler et al. | 405/268 |

FOREIGN PATENT DOCUMENTS

| | | |
|---|---|---|
| CH | 92912 | 2/1922 |
| DE | 19524908 | 1/1997 |
| WO | 03104570 | 12/2003 |

* cited by examiner

*Primary Examiner* — Joshua J Michener
*Assistant Examiner* — Ryan Kwiecinski
(74) *Attorney, Agent, or Firm* — Themis Law

(57) ABSTRACT

A procedure for making swimming pools and artificial lakes in general includes the following steps: excavation of a tank; preparation of a subgrade by spreading the bottom of the excavation with a layer of sand; then spreading one or more sheets of nonwoven fabric on the inside surface of the excavation, over the layer of the subgrade; placement of a waterproofing layer over the sheet(s) of nonwoven fabric; installation of the equipment needed for proper functioning of the tank, swimming pool, etc; and application of a coating on the inside walls and/or on the bottom and/or around the edge of the tank, with holes or interstitial spaces such to enable water contained inside the tank to come into contact with the sheets, wherein the thrust of the water contained in the tank thus comes to bear on the sheets.

10 Claims, 5 Drawing Sheets

PROCEDURE FOR MAKING NATURAL POOLS

The present patent relates to swimming pools, tanks, etc., and particularly concerns a procedure for making swimming pools, fountains and artificial lakes in general, also for swimming.

There are known tanks, fountains and artificial lakes in general for ornamental purposes.

Products of this type are made with a stone coating layer, possibly set in concrete, or simply juxtaposed and overlapping without any binder, i.e. using the drywall technique.

Such tanks may also be used for breeding aquatic species, such as plants or fish.

In this case, the tanks are also fitted with equipment such as filters, pumps, and other water cleansing, oxygenating and circulating means, i.e. for all the operations needed for the survival of the species contained therein.

There are also known environmentally-inserted swimming pools such as the one described in WO 2007/0292277 relating to a swimming pool made with natural coating materials, such as natural or artificial stones.

This swimming pool comprises a bottom and walls prepared with elements that are bonded together and totally or partially coated with resins or other binders, such as concrete. Such swimming pools are designed so that the thrust of the water is absorbed by the coating layer, and this situation is used in particular situations with yielding soil or where, due to the action over time of the water, cracking or fractures may occur, with a consequent detachment of said coating elements.

To overcome the above-mentioned drawbacks, a new type of procedure has been conceived and implemented for the making of swimming pools, tanks, fountains and artificial lakes in general.

The object of the present invention is to avoid any small, localised yielding of the supporting soil or substrate due to the thrust of the water leading to the failure or damaging of the coating or waterproofing layers.

Another object of the present invention is to balance the thrust of the water contained in the tank on both sides of the coating layer on the walls and bottom of the tank.

Another object of the present invention is to enable a swimming pool, tank, fountain, etc., also for swimming, to be made of any shape and size, using natural or similar materials for the finishing layer.

Another object of the present invention is to reduce the management costs incurred and to facilitate maintenance and cleaning procedures.

Another object of the present invention is to reduce the costs of demolition and disposal of the product at the end of its working life.

Another object of the present invention is to produce an aesthetically appealing product that is perfectly integrated in any surroundings, however prestigious.

Another object is to reduce the interference of the new product with the water table and all the other natural and geological components.

Another object is to achieve the product using mainly natural components, such as rocks, stones and sand, and at the same time to reduce the use of industrialised products, such as concrete, steel and ceramic tiles, thereby achieving a reduction in the energy-related and environmental costs.

These and other direct and complementary objects are achieved by the new procedure for making swimming pools, tanks, fountains and artificial lakes in general using natural coating materials.

The procedure substantially comprises a first excavation stage, completed according to known techniques, completed in the required shapes and according to the aesthetic and functional needs of the product.

The next stage involves the preparation of a subgrade by spreading a layer of sand, clay or other suitable material to level the bottom and prevent any presence of elements that might damage the upper layers.

Following the preparation of the subgrade, one or more sheets of nonwoven fabric are used to cover the entire inside surface of the excavation, on which a waterproofing layer is subsequently installed.

Said waterproofing layer is made of one or more sheets of a waterproof polymer material, such as PVC or other material of comparable characteristics and efficacy, e.g. sheets of EPDM.

It is advisable for said waterproofing layer to include overlapping and compensation areas so that said layer can stretch to allow for any settlement of the soil due to geological factors or loading factors.

The subsequent stages consist in the operations for coating the walls and bottom of the tank and in the installation of any suitable equipment needed for it to function properly, such as inlets and outlets, filters, etc.

For the coating of the inside walls and bottom of the tank, the new procedure involves the use of natural materials, such as river rocks, pebbles, sand and stones of various dimensions and particle size distribution.

Said stones are preferably rounded and smooth in shape, i.e. with no sharp edges, for obvious reasons of safety, comfort and aesthetics.

For said purpose, it is preferable to use a river rocks and pebbles that have already been rounded and smoothed naturally by the erosive action of the water.

An equivalent solution involves the use of artificial stones or sand, or similar materials.

The procedure involves the positioning of said stones inside the tank, on top of said waterproofing layer, and fixing them stably in place with the aid of a suitable binder.

Said stones are distributed so as to cover all or part of the inside surface of the tank.

Said binder is distributed evenly both in the interstitial spaces between the layer of coating stones, i.e. between one stone and the next, and so as to entirely or partially cover the outer free surface of said stones.

All the stones are thus completely covered, thereby ensuring that the resulting coating layer is stable.

Alternatively, said binder can be distributed only inside the interstitial spaces in the coating layer so as to effectively fix the stones in position, while leaving their outer free surface uncovered.

In either case, interstitial spaces are left free or created at suitable intervals between said coating stones so that the water contained in the swimming pool, tank or artificial lake passes through said coating layer and comes into contact with said waterproofing layer, so that the thrust of the water comes to bear thereon.

Provision can be made for said coating layer to include a layer of reinforced concrete containing a metal mesh.

Provision can also be made for the coating layer on the inside walls and bottom of the tank to consist of prefabricated concrete elements preferably reinforced with an electrowelded metal mesh and with a further top layer of good-quality natural coating material.

Here again, there are through holes at suitable intervals in the layer of concrete to enable the water contained in the tank to come into contact with said sheets, so that the water contained in the swimming pool, tank or artificial lake passes through said coating layer and comes into contact with the waterproofing layer, bringing the thrust of the water to bear thereon.

With the aid of suitable shapes, it is easier to make all types of profile for the walls and bottom of the tank.

The use of smooth natural stone for the coating of the tank offers numerous advantages.

First of all, the use of this type of material enables excellent results to be obtained even when coating tanks of extremely irregular shape, where the use of known tiles would demand a precise and complicated effort to shape the tiles concerned.

The great variety of shapes and sizes of the stones used also enables extremely original results to be obtained.

The use of natural materials, without any need to use metal, cement, etc, also reduces the visual impact of the product on the surrounding natural environment.

Moreover, natural stone has a very attractive appearance, making this material suitable for the production of ornamental fountains or artificial lakes as well.

Unlike the other materials commonly used, natural stone—when combined with the mass of water—accumulates warmth and thus helps to stabilise the temperature of the water in the tank.

The natural smooth stone coating is therefore extremely advantageous for the swimmers' comfort in addition to enabling the creation of a natural environment that does not necessarily need to be emptied or covered in winter.

The running, maintenance and water heating costs are consequently considerably reduced.

Said stones can also be used to coating the edges around the tank, where overflows, perimeter channels and equipment for collecting, filtering and recirculating the water are usually installed.

Said stones can be suitably placed over said overflows and perimeter channels and the binder distributed so as to avoid saturating the interstitial spaces between the stones, thus leaving channels for the passage of the drainage water.

The stones consequently create a drainage layer around the edge of the tank that allows for the water overflowing from the tank to permeate and be collected in the overflows and perimeter channels.

Said overflows and channels are consequently concealed from view and the aesthetic value of the product is considerably improved thereby.

Alternatively, the present invention can entail the use of artificial stones, be they reproductions of natural elements or otherwise, such as stone slabs, steps, etc.

The interstitial spaces between these coating stones on the walls and bottom of the tank are not filled with the binder used to fix the stones in place, but allow for the water to pass through said coating layer and come into contact with the waterproofing layer so that the thrust of the water in the tank comes to bear directly on said waterproofing layer. Thus, in the event of any localised yielding of the soil or subgrade against which the coating lies, the thrust on either side of the coating, due to the pressure of the water in the swimming pool, tank or artificial lake, is practically cancelled, i.e. it is substantially the same on the facing side of said coating stones in view and on the rear side of said coating stones hidden from view.

Provision can be made for metal or plastic meshes or nets to be used in one or preferably at least two layers in order to structurally consolidate said coating layer.

A procedure for making tanks, swimming pools, fountains and artificial lakes in general, comprising the stages in which: the hole is dug for the tank; the bottom of the excavation is spread with at least one layer of sand, clay or other suitable subgrade material; then one or more sheets of nonwoven fabric are laid over the inside surface of the excavation, on top of the subgrade; then a waterproofing layer is placed on top of said sheets of nonwoven fabric; filters, piping, inlets and outlets, drainage channels and all the equipment needed for the proper functioning of said tanks, swimming pools, etc, are installed; the inside walls and the bottom of the tank are then coated with stones placed on top of said waterproofing layer previously treated with a binder of the resinous type and/or after the application of a suitable binder to said coating stones; and said coating layer comprises holes or interstitial spaces passing through its thickness so as to enable the water contained in the tank to come into contact with said sheets, and the thrust of the water contained in the tank thus comes to bear on said sheets.

A preferred embodiment that includes mixing the resin with the stones just before their application, with the aid of a cement mixer.

Moreover, two different layers of coating material can be applied, i.e. a first layer of material with a larger particle size distribution underneath and a second facing layer of finer, better-quality material. Here again, the material used is premixed in a concrete mixer so the elements adhere to one another when they come into contact and, because of their shape, various spaces remain through which the water in the swimming pool easily passes, making the thrust of the water come to bear on the waterproofing sheets and not on the coating.

The characteristics of the new procedure for making tanks, swimming pools, fountains and artificial lakes in general is better clarified in the description that follows with reference to the drawings, which is attached as a non-limiting example.

Figure 1:
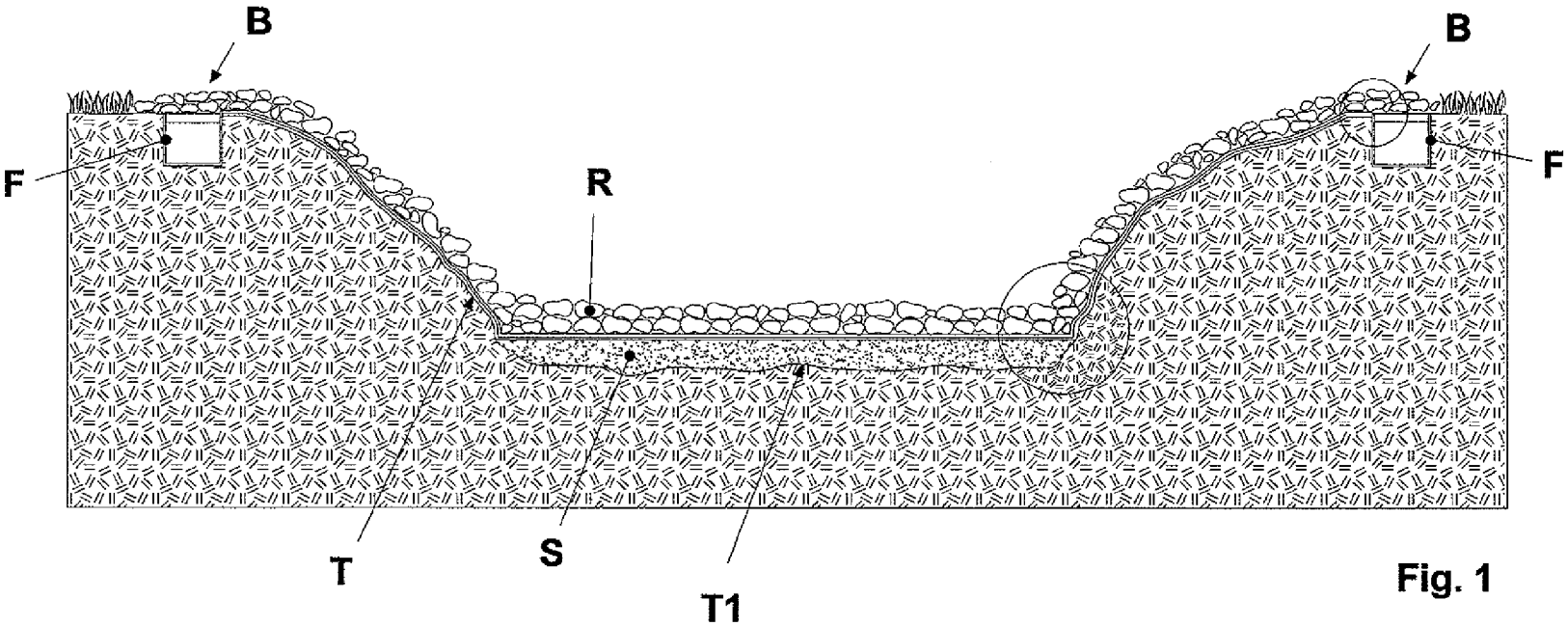
FIG. 1 shows a simplified version of a cross-sectional view of the tank, without showing the details of the drainage equipment, filters, pumps, etc.
Figure 2:
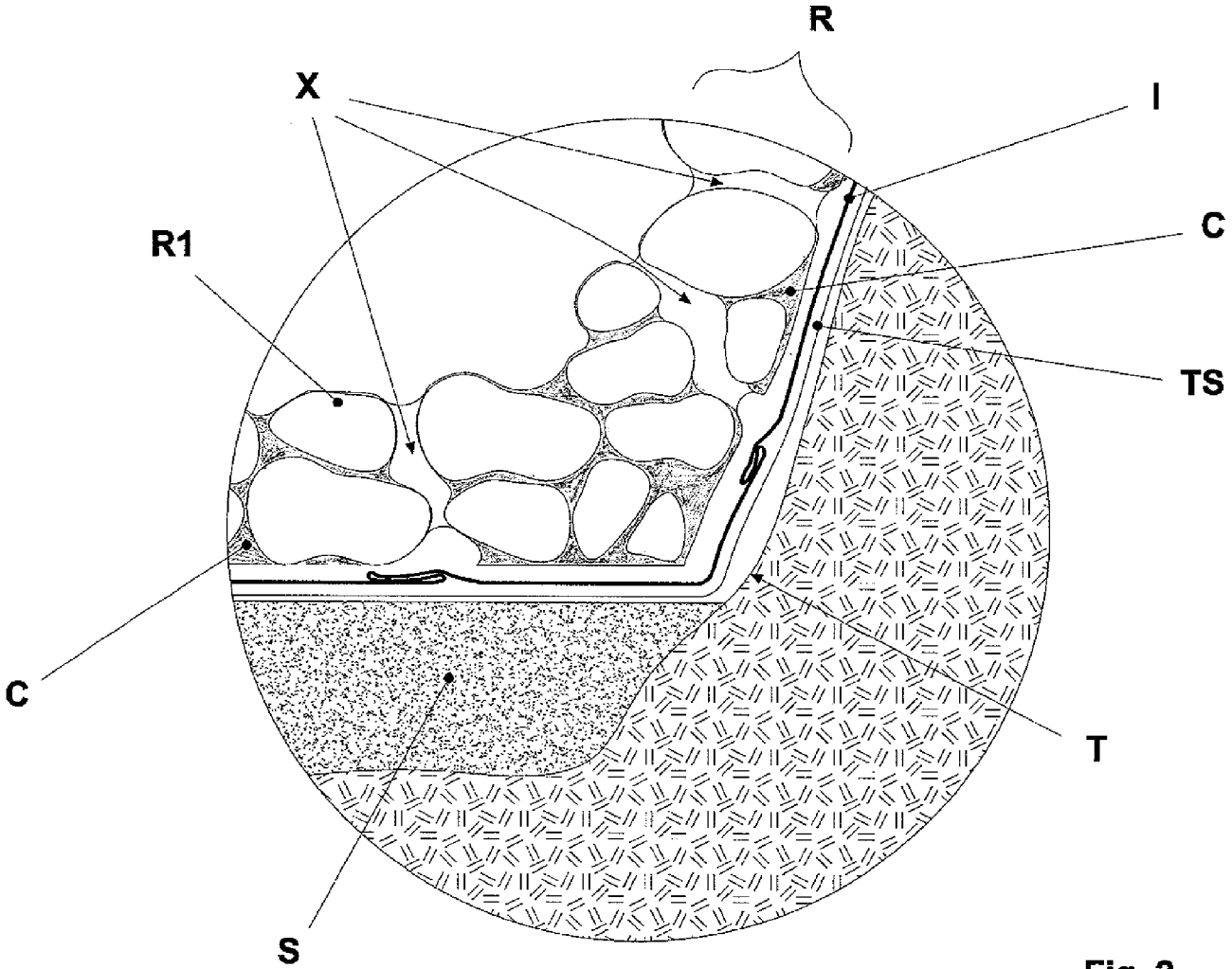
FIG. 2 is a detail of FIG. 1, showing the constituent layers of the product.
Figure 2A:
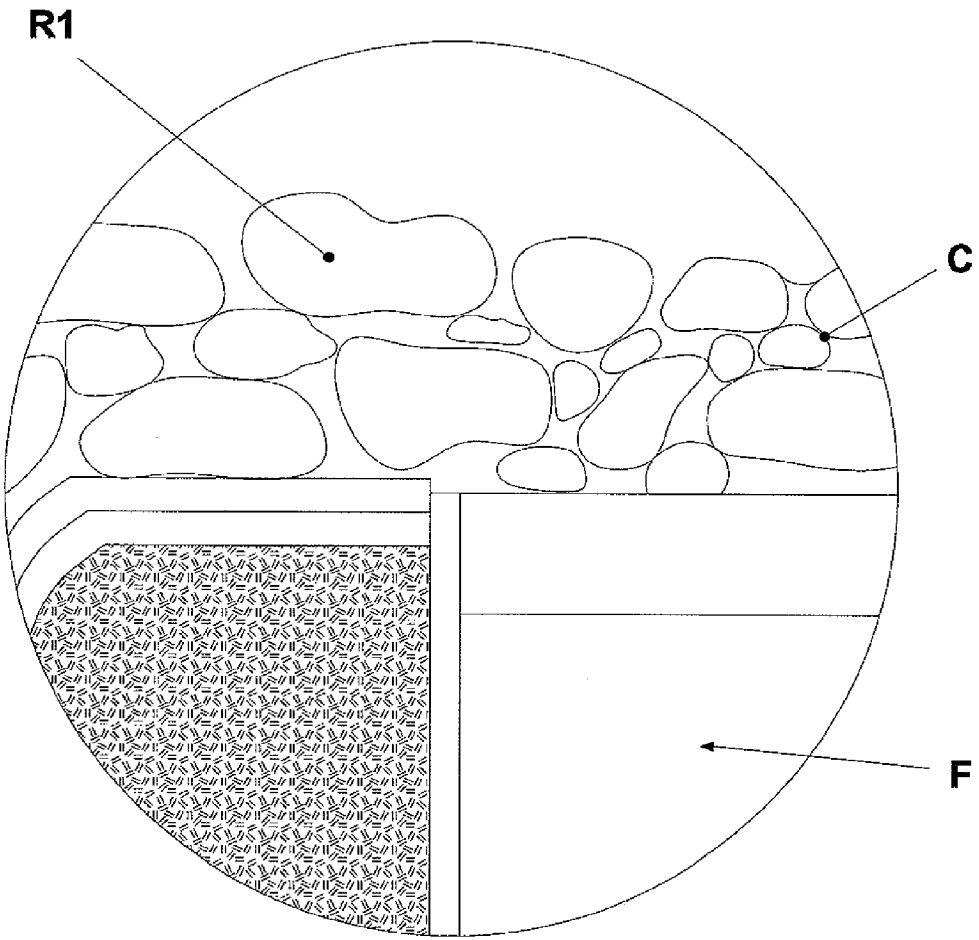

FIG. 2*a* shows a detail of the overflow and perimeter channel (F) covered with the coating stones.

Figure 3:
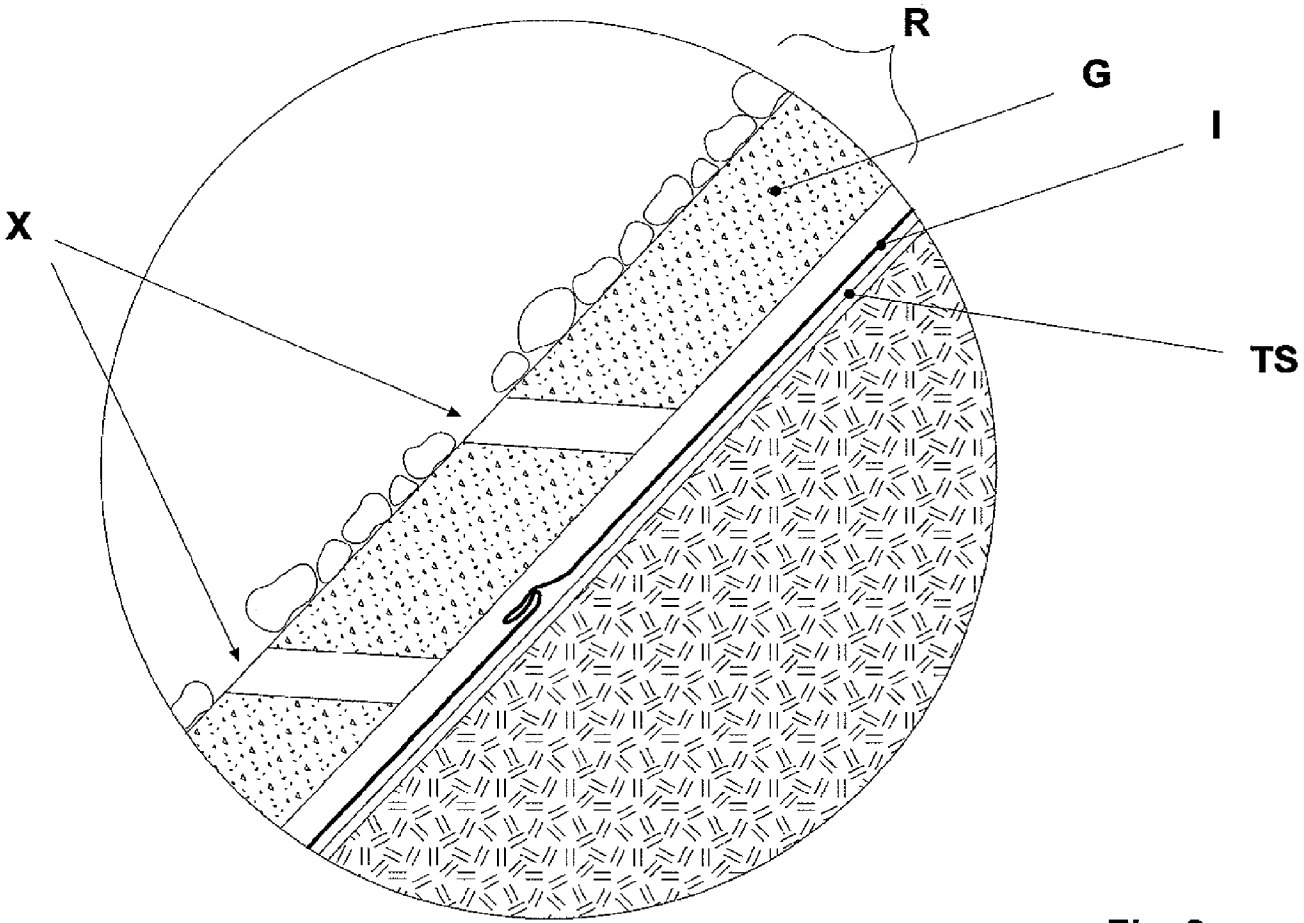

FIG. 3 shows a solution with a coating (R) in the form of a slab (G).

Figure 4:
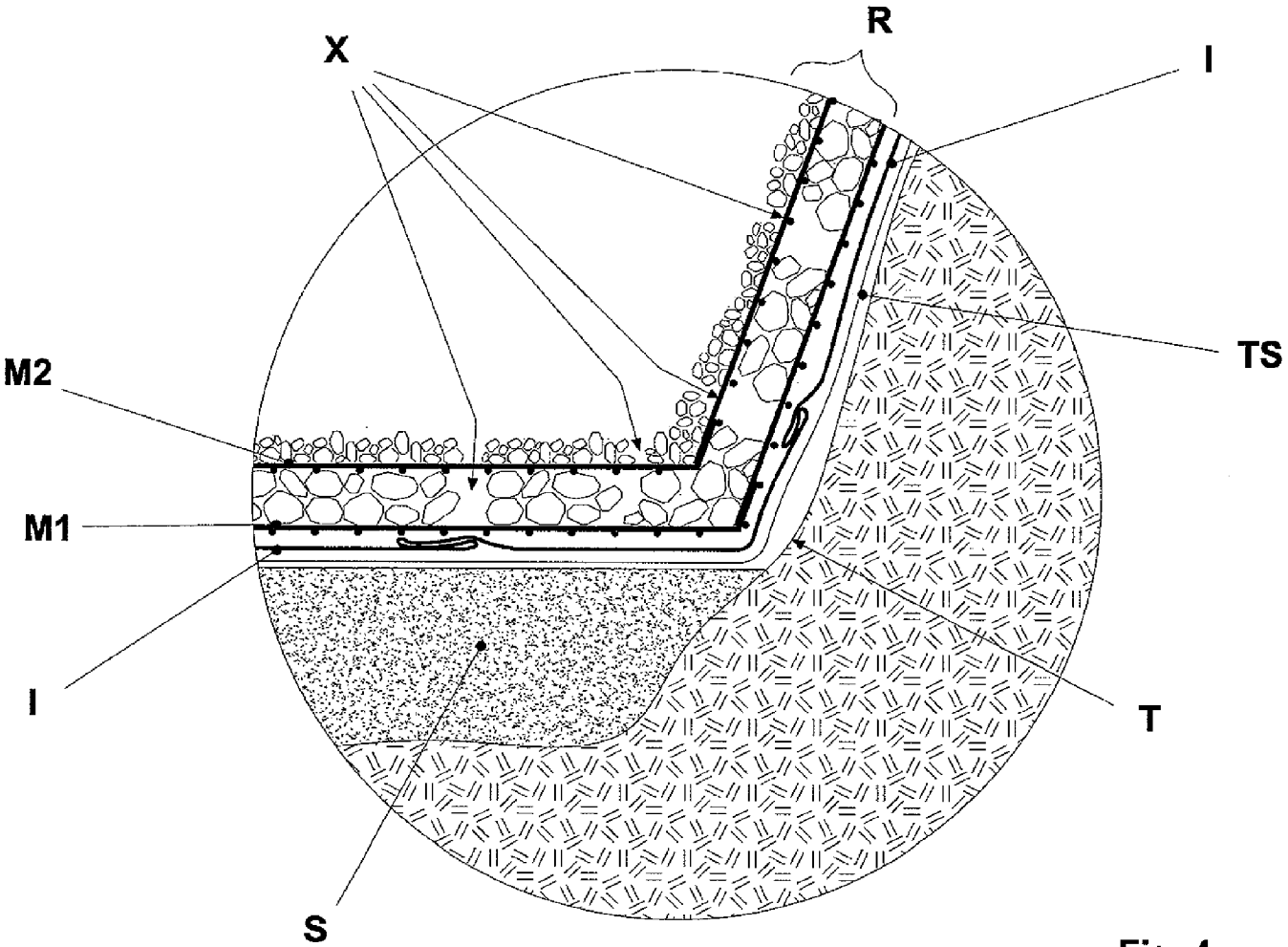

FIG. 4 shows a detail of an embodiment of a tank with more than one net or mesh.

The excavation (T) is prepared using the known technique, according to the methods required to meet the building needs.

Said excavation (T) may made in any shape and depth, according to the buyers' requirements.

To make the bottom of the excavation (T) smooth, a subgrade (S) is prepared by spreading a layer of sand, clay or other suitable material to level the bottom of the excavation (T).

Said subgrade (S) is spread with a sheet (TS) of nonwoven fabric, which is then covered with the waterproofing layer, (I) with any folds needed to allow for stretching.

Said waterproofing layer (I) is a sheet made of a polymeric material such as PVC, or another waterproof material with similar features.

The subsequent phases involve the operations for coating the walls of the tank and the installation of suitable equipment needed for functional purposes, such as inlets and outlets, filters, etc.

To prepare the coating (R) of the inside walls and bottom of the tank, the new procedure involves the use of natural material, such as river rocks (R1), pebbles and other stones of various shape and size, preferably rounded and smooth, i.e. with no sharp edges.

The procedure involves positioning said stones (R1) inside the tank, on top of the waterproofing layer (I), so as to cover the whole inside surface of the tank, possibly including one or more meshes or nets (M1, M2) made of a material used for structural consolidation.

Said coating layer (R) is stabilised by applying a suitable binder (C), so as to fix the stones (R1) in the required position.

Said binder (C) can be distributed homogeneously so as to cover all or part of said stones (R1).

Either way, at suitable intervals, interstitial spaces (X) are deliberately created, or left thanks to the rounded shape of the stones (R1), in between said coating stones (R1) so that the water contained in the swimming pool, tank or artificial lake passes through said coating layer (R) and comes into contact with the waterproofing layer (I), so that the thrust of the water comes to bear directly on the latter (FIG. 2).

Said smooth natural stones (R1) can also be used for coating the edge (B) around the tank, where overflows, perimeter channels (F), and equipment for collecting, filtering and recirculating the water are usually installed.

Said natural stone (R1) is placed around the edge (B) of the tank, distributing the binder (C) so as to avoid saturating all the interstitial spaces between the stones (R1), in order to create a drainage layer through which the water can permeate and thus, in addition to coming to bear on the waterproofing layer (I), it can overflow from the tank and be collected in the perimeter channels (F) beyond the overflows (FIG. 2*a*).

FIG. 3 shows a detail of an embodiment in which the coating layer (R) comprises a concrete slab (G) with holes (X) such that the water contained in the swimming pool, tank or artificial lake passes through said coating layer (R) and comes into contact with the waterproofing layer (I), so that the thrust of the water comes to bear thereon.

FIG. 4 shows an embodiment comprising a first mesh or net (M1) made of a material for structural consolidation laid on top of the waterproofing layer (I), on which a first coarse layer of coating material is placed. A second mesh or net (M2) is placed on top of this first layer, on which a second finishing layer is placed that is finer and aesthetically more appealing.

Thus, with reference to the above description and to the attached drawings, the following claims are advanced.

The invention claimed is:

1. A procedure for making a liquid receptacle comprising the following steps:

excavating a tank having a bottom and inside walls;

preparing a subgrade layer by spreading at least one layer of sand or clay on the bottom of the tank;

spreading one or more sheets of a nonwoven fabric over an inside surface of the tank on top of the subgrade layer;

installing a waterproofing layer on top of said one or more sheets of the nonwoven fabric;

and installing filters, piping, inlets, outlets, and drainage channels as required for proper functioning of said liquid receptacle;

wherein the procedure comprises applying a coating layer comprising stones on top of said waterproofing layer on one or more of said inside walls of the tank or said bottom of the tank, all of said stones being entirely or partly coated with a binder, said stones being distributed to create interstitial holes therebetween so to enable water contained in the liquid receptacle to come into contact with said waterproofing layer, so that thrust of the water contained in the liquid receptacle comes to bear on said waterproofing layer.

2. The procedure according to claim 1, wherein said coating layer comprises at least two layers of said stones, one layer of said at least two layers with coarser stones underneath another one of said at least two layers forming a facing layer with finer stones.

3. The procedure according to claim 1, further comprising the step of mixing said binder with said stones before said stones are placed in position.

4. The procedure according to claim 3, wherein said coating layer comprises one or more meshes or nets of a material disposed therein.

5. The procedure according to claim 4, wherein said coating layer comprises a first mesh or net made of a material placed over the waterproofing layer, a first coarse layer of said stones being applied on the first mesh or net, a second mesh or net being placed on the first coarse layer, and a second, finer layer of said stones being applied on the second mesh or net.

6. The procedure according to claim 3, wherein said liquid receptacle further comprises a perimeter channel for collecting overflowing water, and wherein additional stones are also placed over said perimeter channel, thereby creating a drainage layer permeable to the water wherein said binder is distributed so as to avoid saturating said interstitial holes between the stones.

7. The procedure according to claim 3, wherein said stones are smooth natural stones covered with said binder.

8. The procedure according to claim 3, wherein said stones are artificial and covered with said binder.

9. The procedure according to claim 1, wherein said coating layer further comprises an inner layer of reinforced concrete provided with said interstitial holes.

10. The procedure according to claim 1, wherein the liquid receptacle is a tank, a swimming pool, a fountain, or an artificial lake.

* * * * *